US006124572A

United States Patent [19]

Spilger et al.

[11] Patent Number: 6,124,572

[45] Date of Patent: Sep. 26, 2000

[54] FOOD WARMER CABINET HAVING AN IMPROVED DRAWER SLIDE ASSEMBLY

[76] Inventors: Jon Barton Spilger, 5811 Brigstone, Katy, Tex. 77450; Donald Jon Spilger, 14120 Apple Tree Rd., Houston, Tex. 77079

[21] Appl. No.: 09/400,022

[22] Filed: Sep. 21, 1999

[51] Int. Cl.[7] ..... A47B 88/04; A47B 88/08; A47J 36/24; A21B 1/26; F24C 15/18

[52] U.S. Cl. ..... 219/400; 219/394; 312/334.8; 312/334.31

[58] Field of Search ..... 219/385, 386, 219/392, 394, 400; 99/483; 126/21 A, 339; 312/330.1, 334.16, 334.22, 334.31, 334.36, 334.8, 334.7

[56] References Cited

U.S. PATENT DOCUMENTS

| | | | |
|---|---|---|---|
| 221,307 | 11/1879 | Hirsch | 312/334.44 |
| 893,187 | 7/1908 | Montague . | |
| 2,757,051 | 7/1956 | Wilmer et al. . | |
| 3,490,823 | 1/1970 | Neu et al. | 312/330.1 |
| 4,440,462 | 4/1984 | Manson . | |
| 4,700,685 | 10/1987 | Miller | 219/400 |
| 4,780,596 | 10/1988 | Matsushima et al. | 219/400 |
| 4,953,990 | 9/1990 | Wojcik . | |
| 5,142,125 | 8/1992 | Fioroli et al. | 219/400 |
| 5,308,956 | 5/1994 | Halters et al. | 219/400 |
| 5,451,744 | 9/1995 | Koopman et al. | 219/400 |
| 5,466,060 | 11/1995 | Hoffman . | |
| 5,601,070 | 2/1997 | Hotard et al. | 126/21 A |
| 5,620,623 | 4/1997 | Baker | 219/400 |
| 5,695,262 | 12/1997 | Wachtler | 312/330.1 |
| 5,816,234 | 10/1998 | Vasan | 126/21 A |

FOREIGN PATENT DOCUMENTS 3015286 11/1980 Germany .

4104962 8/1982 Germany .

OTHER PUBLICATIONS

Half–Height Heated Insulated Metal Cabinet—C90 Series, InterMetro Industries Corporation, Copyright 1987, pp. 1–2.

Uninsulated Holding Cabinets—C175 Series, InterMetro Industries Corporation, Copyright 1990, pp. 1–2.

Large Capacity Drawer Warmer With Shallow Depth Design, Star Manufacturing International, Inc., Copyright Unknown, pp. 1–2.

Drawer Warmers, Wells Manufacturing Compnay, Copyright 1994, p. 1.

Hot Food Servers Freestanding, Toastmaster Electric Cooking Equipment, Copyright Unknown, p. 1.

Halo Heat Cook/Hold/Serve Systems, Alto–Shaam, Copyright Unknown, p. 1.

Drawer Warmers, Hatco Corporation, Copyright Unknown, p. 1.

No other Drawer Measures Up!, Hatco Corporation, Copyright Unknown, p. 1.

*Primary Examiner*—Joseph Pelham

*Attorney, Agent, or Firm*—Dunlap, Codding & Rogers, P.C.

[57] ABSTRACT

A food warmer cabinet and improved drawer slide assembly for keeping prepared food warm is provided. The food warmer cabinet comprises a housing assembly, a plurality of slide assemblies, at least one drawer, and a convection heater. The a plurality of slide assemblies are supported within the heating chamber. At least one drawer is slidably supported by the slide assemblies such that the drawer can be slidably positioned within the heating chamber and slidably removed from the heating chamber. The drawer has an interior cavity for receiving a food storage container. The convection heater is supported within the heating chamber such that the drawer can be slidably positioned within the heating chamber and slidably removed from the heating chamber.

19 Claims, 4 Drawing Sheets

FOOD WARMER CABINET HAVING AN IMPROVED DRAWER SLIDE ASSEMBLY

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to a food warmer cabinet having a drawer slide, and more particularly, but not by way of limitation, to an improved convection heated counter-height food warmer cabinet having an improved drawer slide assembly for extending and supporting a drawer.

2. Description of Related Art

Warming devices, such as food warming cabinets, are often used in restaurants to keep prepared foods at serving temperature prior to being served to restaurant patrons. Also, foods which require more preparation time are frequently prepared in advance and kept hot in these devices for later service to patrons.

Additionally, there is a need to rethermalize chilled or frozen foods in a manner that meets requirements of local health departments. Rethermalizing foods in an enclosed and temperature controlled environment is essential to ensure that all the foods are brought to serving temperature within recommended health department guidelines. The ability to rethermalize foods in a consistent time frame reduces, if not eliminates, the need for secondary warming containers. Where foods can be brought to serving temperature reasonably fast, serving lines can be replenished on an "as needed" basis, enhancing the flavor and texture of prepared foods.

Full size holding or delivery type food warmer cabinets are typically larger than counter-height food warmer cabinets. Thus, the full size food warmer cabinets have more shelving and subsequently retain a greater amount of food. However, work space is generally scarce in a commercial restaurant kitchen and full size food warmer cabinets occupy areas needed for food preparation. Although counter-height food warmer cabinets cannot retain as much food as full size food warmer cabinets, counter-height food warmer cabinets are implemented since they both warm food and provide valuable work space on the top thereof.

The exterior height and width of these counter-height food warmer cabinets are similar since the kitchen area is sized to accept a counter-height food warmer cabinet based on generally accepted restaurant specifications. Thus, a counter-height food warmer cabinet which provides more interior food storage space, given the fixed exterior specifications, is desirous.

The counter-height food warmer cabinets must be capable of quickly and evenly heating food. Commonly, heating elements, such as radiant heaters, are disposed in an area under each drawer of the food warmer cabinet. The placement of the heating elements under each drawer of the food warmer cabinet displaces valuable food storage space within the lower drawer area. Also, these heating elements concentrate the heat toward the lower or central portion of the drawer. Thus, food nearer the edges or top of the drawer are not warmed as quickly or to the high temperature of the foods placed in the center or bottom of the drawer.

Convection heating systems heat food more rapidly and evenly than the above described heating elements since the heat is circulated throughout the interior of the food warmer cabinet and surrounds the food. Therefore, regardless of the placement of the food, the food is evenly and rapidly heated to the desired temperature. Additionally, convection heating systems use electrical power more efficiently and are, therefore, less costly to operate.

The drawers of the food warmer cabinets are desirably fully extendable so that the food may be easily inserted and retrieved from the drawer. A fully extendable drawer allows for food to be placed directly into the interior drawer storage area without tipping the food storage container. That is, if a drawer is not fully extendable from the food warmer cabinet, the food storage container must be tipped upon insertion into the drawer and the food placed thereon could easily slide about the food storage container.

Typically, when conventional industry standard drawers become loaded with food, the slides which attach the drawers to the food warmer cabinet frequently buckle, bend, or fail to operate efficiently. A heavily laden drawer may cause the slides to bend slightly when the drawer is fully extended. Upon closing the drawer, the slide bends or buckles to a point where the slide is inoperable. Also, the harsh conditions of a commercial kitchen cause spilled food, grease and other materials to build-up on the drawer slide components which further hinders their operation.

Drawer slides which include many components, such as ball-bearings and track-wheels, are problematic under these conditions since they fail to operate properly when coated with food particles and grease. Drawer slides constructed of more rigid material, such as heavy gauge stainless steel, are capable of supporting the loaded drawers; however, slides constructed of this material are expensive to construct, but still have the inherent operational problems as lighter components.

Various drawer slides exist for supporting drawers in a wide range of applications outside of the food industry, such as household and office furniture. However, these drawer slides suffer from similar inefficiencies such as being complicated and expensive to construct, unable to support a significant amount of weight, bending, buckling and generally becoming inoperable when subjected to heavy loads.

To this end, a need exists for a food warmer cabinet which provides maximum interior storage space and which can implement a convection heating system for more evenly and efficiently heating food. In addition, a need exists for a drawer slide which is simple to construct and capable of fully extending a heavily weighted drawer with the drawer slide remaining operable under harsh conditions, hot or cold. It is to such a device that the present invention is directed.

SUMMARY OF THE INVENTION

In one aspect, the present invention is directed to a food warmer cabinet for re-thermalizing cold foods, keeping prepared food warm, or the direct serving of foods or related products, such as plates and hot napkins. The food warmer cabinet comprises a housing assembly, a plurality of slide assemblies, at least one drawer, and a convection heater assembly. The housing assembly defines a heating chamber. The housing assembly has at least one drawer receiving opening in one side thereof which openly communicates with the heating chamber. A plurality of slide assemblies are supported within the heating chamber.

At least one drawer is slidably supported by at least two slide assemblies such that the drawer can be slidably positioned within the heating chamber and slidably removed from the heating chamber. The drawer has an interior cavity for receiving and supporting a variety of food containers. The convection heater assembly is supported by the housing assembly such that the drawer can be slidably positioned within the heating chamber and slidably removed from the heating chamber without interference from the convection heater and heated air can be injected into the heating chamber by the convection heater assembly.

The convection heater assembly comprises a plenum, a fan, a heating element, and a motor. The plenum includes a front, a back, an air inlet, and an air outlet. The fan is substantially cylindrical shaped and disposed substantially adjacent the back of the plenum. The fan is provided with a back plate and a plurality of arcuate blades. The plurality of arcuate blades connected to the back plate of the fan so as to extend therefrom. The plurality of arcuate blades being spaced circumferentially about the back plate to form an outer periphery of the fan. The heater element is disposed about a portion of the outer periphery of the fan and spaced a distance from the outer periphery of the fan. The motor is operably connected to the fan for imparting a rotating movement upon the fan.

In another aspect, the present invention is directed to an improved slide assembly for supporting a drawer. The slide assembly comprises a tubular transportal member, a rod, a tubular support member, and a support bracket. The tubular transportal member has a first end, a second end, and a side wall defining a rod receiving passageway there through. The tubular transportal member has a first slot and a second slot openly communicating with the rod receiving passageway. The first slot extends from the first end of the tubular transportal member and terminates a distance from the first end of the tubular transportal member. The second slot extends from the second end of the tubular transportal member and terminates a distance from the second end of the tubular transportal member. The first and second slots are aligned and terminate a distance apart such that a portion of the side wall is disposed there between.

The rod has a first end, a second end, a first flange, and a second flange. The first flange is connected to the rod near the first end of the rod and the second flange is connected to the rod near the second end of the rod. The rod is telescopingly disposed within the rod receiving passageway of the tubular transportal member.

The tubular support member has a first end, a second end, and a side wall defining a tubular receiving passageway. The tubular transportal member is telescopingly positioned in the tubular receiving passageway of the tubular support member for reciprocating movement therebetween. The tubular support member further has a slot which extends through the side wall from the first end of the tubular support member to the second end of the tubular support member. The slot formed in the side wall of the tubular support member is aligned with the first and second slots formed in the tubular transportal member. The slot formed in the side wall of the tubular support member is sized to receive the first and second flanges of the rod for sliding movement therein The support bracket is attached to the side wall of the tubular support member. The support bracket has a flange extending therefrom for attachment to a stable object to support the slide assembly. For example, the stable object can be a cabinet, or the housing assembly.

Other objects, features, and advantages of the present invention will be apparent to those skilled in the art from the following detailed description when read in conjunction with the accompanying drawings and appended claims.

BRIEF DESCRIPTION OF THE SEVERAL VIEWS OF THE DRAWING

FIG. 6 is a perspective representation of the slide assembly with a portion of the drawer supported by the slide assembly shown in phantom.

DETAILED DESCRIPTION OF THE INVENTION

Figure 1:
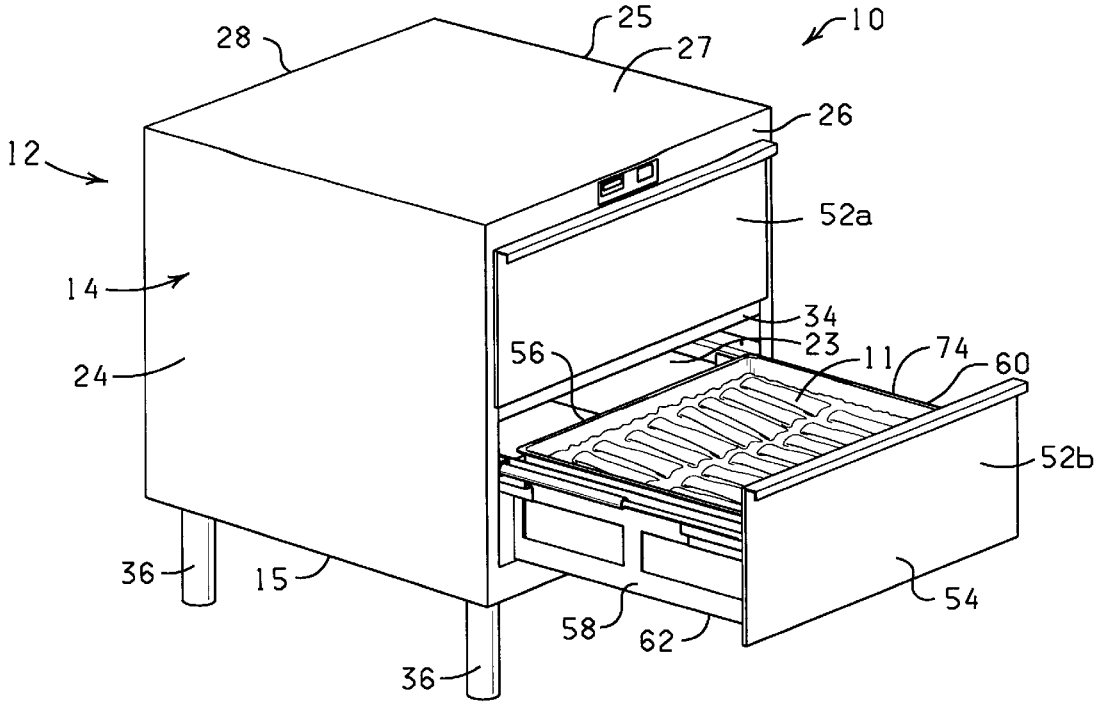
FIG. 1 is a perspective representation of a food warmer cabinet constructed in accordance with the present invention, with a bottom drawer extended.
Figure 2:
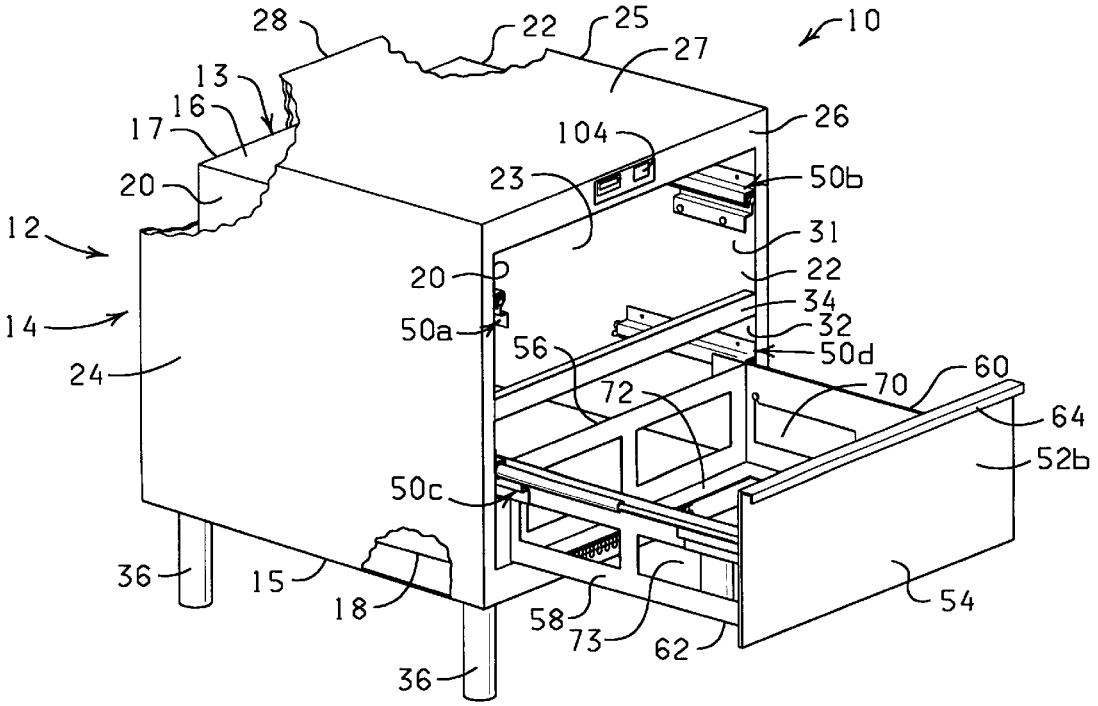
FIG. 2 is a perspective representation of the food warmer cabinet illustrated in FIG. 1 with a top drawer removed, the bottom drawer extended, and a partial cut-away illustrating an inner shell of the food warmer cabinet.

Referring now to the drawings, and more particularly to FIGS. 1 and 2, a food warmer cabinet 10 constructed in accordance with the present invention is illustrated. The food warmer cabinet 10 of the present invention can be used by a food service business, such as a restaurant, to keep a prepared food 11 at serving temperature until the prepared food 11 is served to patrons.

The food warmer cabinet 10 includes a housing assembly 12 having an inner shell 13, an outer shell 14 and a base 15. The inner shell 13 includes a top 16, a back 17, a bottom 18, a first side wall 20, a second side wall 22. The top 16, the back 17, the bottom 18, the first side wall 20, and the second side wall 22 cooperate to define a heating chamber 23. The outer shell 14 includes a first outer wall 24, a second outer wall 25, a front guard 26 and a top 27.

Figure 3:
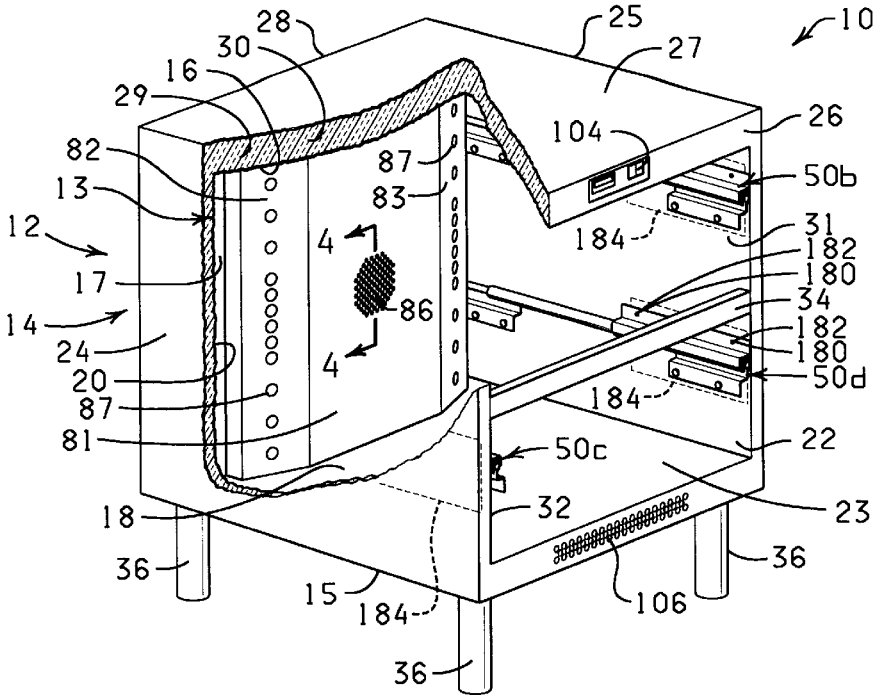
FIG. 3 is a partial cut-away representation of the food warmer cabinet illustrating a convection heater assembly supported by a housing assembly of the food warmer cabinet

The outer shell 14 is shaped and configured so as to be disposed over the inner shell 13. The housing assembly 12 further includes a back cover 28 which is attached to the outer shell 14 and is disposed so as to enclose the back 17 of the inner shell 13. Referring more specifically to FIG. 3, the first and second outer walls 24 and 25 and the front guard 26 of the outer shell 14 and the back cover 28 are spaced a distance from the top 16, back 17, bottom 18, and first and second side walls 20 and 22 of the inner shell 13 so as to define an insulation cavity 29 therebetween. To promote retention of heat within the heating chamber 23 and to improve the efficiency of the food warmer cabinet 10, an insulating material 30, such as fiberglass insulation, is disposed within the insulation cavity 29.

The front guard 26 frontally extends from the outer shell 14 so as to enclose the top 16, and first and second side walls 20 and 22 of the inner shell 13. The front guard 26 of the outer shell 14, disposed over the inner shell 13, provides an upper drawer-receiving opening 31 and a lower drawer-receiving opening 32 in the housing assembly 12. The upper drawer-receiving opening 31 and the lower drawer-receiving opening 32 are in openly communicate with the heating chamber 23. A separation member 34 is disposed across the front of the food warmer cabinet 10 to separate the upper drawer-receiving opening 31 from the lower-drawer receiving opening 32.

The housing assembly 12 further includes a plurality of support members 36 connected to the base 15 of the housing assembly 12. It will be understood that the support members 36 provide for variation in the overall height of the food warmer cabinet 10.; therefore, the support members 36 can be removed for installation of the food warmer cabinet 10 in under-counter applications.

Referring again to FIGS. 2 and 3, a plurality of slide assemblies 50 are spatially disposed within the heating chamber 23. Each of the slide assemblies 50 is similar in construction and function, except as provided below. For purposes of clarity, the specific slide assemblies 50 are referred to herein as 50*a*, 50*b*, 50*c* and 50*d*. The slide assembly 50*a* is supported on the first side wall 20 of the inner shell 13 and the slide assembly 50*b* is supported on the second side wall 22 of the inner shell 13 such that the slide assembly 50*a* and the slide assembly 50*b* are oppositely disposed in a parallel relationship within the heating chamber 23.

The slide assembly 50*c* is supported on the first side wall 20 of the inner shell 13 and the slide assembly 50*d* is supported on the second side wall 22 of the inner shell 13 such that the slide assembly 50*c* and slide assembly 50*d* are oppositely disposed in a parallel relationship within the heating chamber 23. It will be noted that the slide assemblies 50*a* and 50*c* are mounted such that the slide assemblies 50*a* and 50*c* are mirror images of the slide assemblies 50*b* and 50*d*. Referring to FIGS. 1–3, the food warmer cabinet 10 is provided with a top drawer 52*a* and a bottom drawer 52*b*. The top and bottom drawers 52*a* and 52*b* are substantially identical in construction and function. Thus, for purposes of clarity, only the bottom drawer 52*b* will be described in detail hereinafter. It will be understood that the food warmer cabinet 10 can have any number of drawers depending on the particular application in which the food warmer cabinet 10 is intended to be used. For example, the food warmer cabinet 10 can only be provided with one drawer, or be provided with three, four or more drawers.

The bottom drawer 52*b* is connected to and supported by the slide assemblies 50*c* and 50*d*. The slide assemblies 50*c* and 50*d* permit the drawer 52*b* to be slidably inserted within the heating chamber 23 and to be slidably withdrawn from the heating chamber 23 via the opening 32 in the front guard 26 of the housing assembly 12.

The drawer 52*b* is provided with a front 54, a back 56, a first side 58, a second side 60, a bottom 62, and a handle 64; The front 54, the back 56, the first side 58, the second side 60, and the bottom 62 cooperate to define an interior cavity 70 (see FIG. 2). A ledge 72 is disposed about the bottom 62 of the drawer 52*b* for supporting a food storage container 74 (see FIG. 1) when the food storage container 74 is positioned within the interior cavity 70. The ledge 72 defines an opening 73 in the bottom 62 of the drawer 52*b*. The opening 73 is in open communication with the heating chamber 23.

The food storage container 74 is adapted to receive the prepared food 11 and can be constructed from a durable material such as polymeric material, aluminum, sheet metal or other materials suitable for such purposes. The food storage container 74 can be of a variety of standard food storage containers, such as a polycarbonate tub of approximately 18"×26"×(9" or 6" or 3" deep), configured to maintain the food storage container 74 within the interior cavity 70 of the drawer 52*b*.

The handle 64 is attached to the front 54 of the drawer 52*b*. However, it will be understood that the handle 64 shown is only one such handle 64 which can be implemented on the front 54 of the drawer 52*b*. The handle 64 can be any suitable structure attached to the drawer 52*b* which is easily graspable by the hand of an individual and suited for such purpose.

Figure 4:
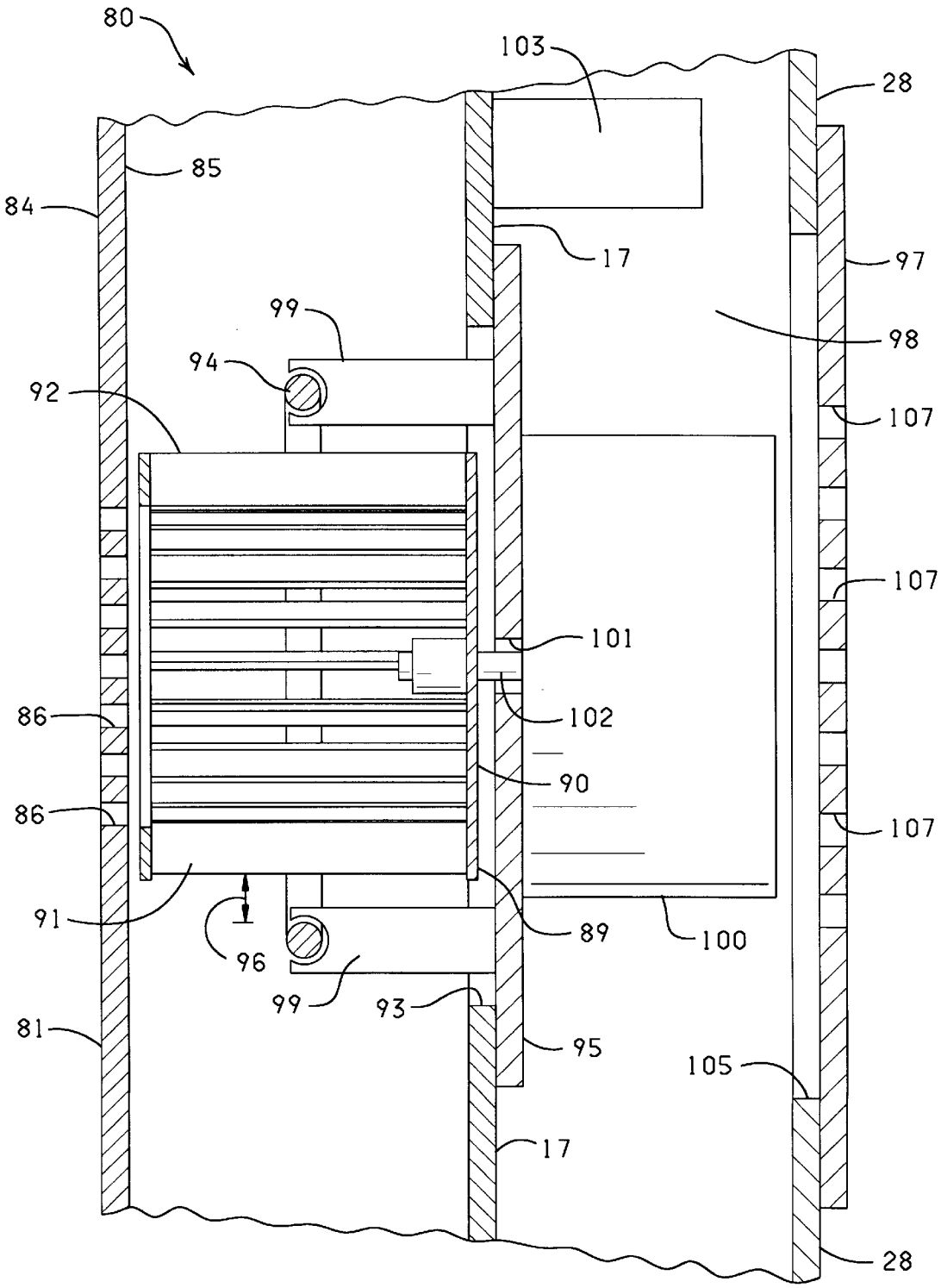
FIG. 4 is a cross-sectional view of the convection heating assembly shown in FIG. 3 taken along 4—4 thereof.
Figure 5:
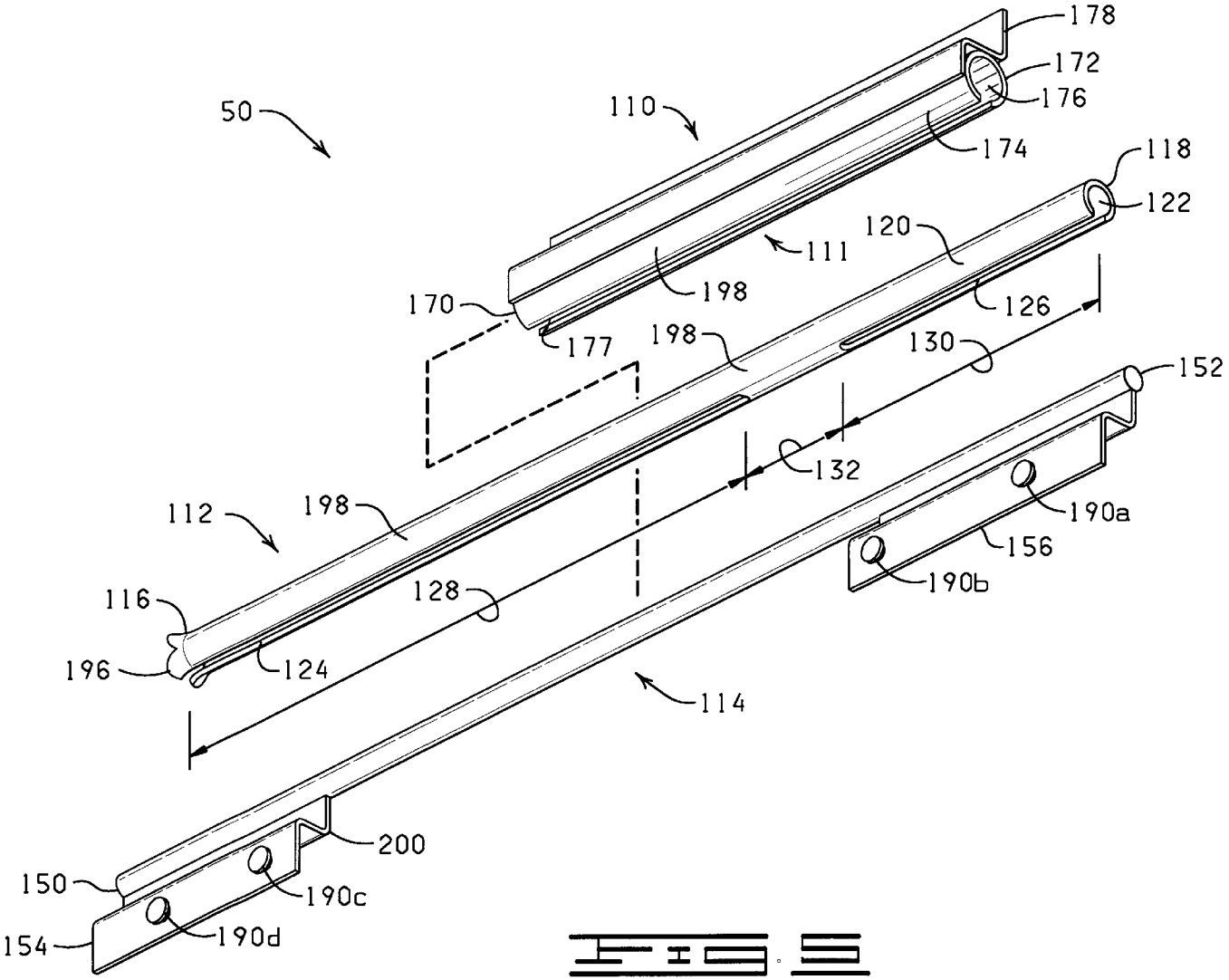

Referring to FIGS. 3 and 4, a convection heater assembly 80 is disposed within the heating chamber 23 and is supported by the back 17 of the inner shell 13. The convection heater 80 injects heated air into the heating chamber 23. The convection heater assembly 80 can be positioned substantially adjacent at least a portion of the back 17 of the inner shell 13. The convection heater assembly 80 is provided with a plenum 81. The plenum 81 has a first side 82, a second side 83, a front 84, a back 85, and at least one air inlet 86 centrally disposed.

A plurality of air inlets is shown and only one is designated by the reference numeral 86. The plenum 81 is also provided with at least one air outlet 87. A plurality of air outlets is shown and only one is designated by the reference numeral 87 for purposes of clarity. In use, the convection heater assembly 80 intakes air from within the heating chamber 23 from the front 84 of the plenum 81 through the centrally disposed air inlet 86.

The convection heater assembly 80 further includes a substantially cylindrically shaped fan 89 which is disposed substantially adjacent the back 85 of the plenum 81. The fan 89 includes a back plate 90 and a plurality of blades 91 connected to the back plate 90. The blades 91 may be any shape, such as arcuate, capable of generating an air flow substantially outwardly from the fan 89. The fan 89 can be any substantially cylindrically shaped fan 89, such as a blower wheel fan. The blades 91 are connected to the back plate 90 and extend substantially perpendicular therefrom. The plurality of blades 91 can be disposed in a substantially parallel relationship such that the blades 91 are spaced circumferentially about the back plate 90 to form an outer periphery 92 of the fan 89.

The convection heater assembly 80 further includes a heater element 94. The heater element 94 is disposed about a portion of the outer periphery 92 of the fan 89 and spaced a distance 96 from the outer periphery 92 of the fan 89. The heater element 94 can be a Chromalox Model CH137 available from Wiegand Appliance Division of Emerson Electric Company, P.O. Box 1439, Vernon, Ala. 35592. The heater element 94 is known in the art and, therefore, no further discussion is deemed necessary to teach one of ordinary skill in the art about its construction and operation.

The back 17 of the inner shell 13 is provided with a centrally disposed opening 93 therein. A mounting plate 95 is attached to the back 17 of the inner shell 13 such that the mounting plate 95 substantially encloses the centrally disposed opening 93 in the back 17 of the inner shell 13. A plurality of mounting clips 99 is attached to the heater element 94 and retains the heater element 94 disposed the distance 96 from the outer periphery 92 of the fan 89.

The back cover 28 of the housing assembly 12 is provided with a substantially centrally disposed opening 105 therein. A cover plate 97 is attached to the back cover 28 of the housing assembly 12 such that the cover plate 97 substantially encloses the centrally disposed opening 105 of the back cover 28. It can be seen that the back cover 28 and attached cover plate 97 are spatially disposed from the mounting plate 95 attached to the back 17 of the inner shell 13 so as to form a cavity 98 therebetween.

A motor 100 is positioned within the cavity 98 substantially adjacent the mounting plate 95. The mounting plate 95 is provided with an opening 101 therein such that a shaft 102 of the motor 100 can be journally extended therethrough and connected to the back plate 90 of the fan 89. Thus, the motor 100 is operably connected by the shaft 102 to the fan 89 such that activation of the motor 100 imparts a rotating movement upon the shaft 102 which is further imparted upon the fan 89. A power supply 103 is attached to the back 17 of the inner shell 13 and operably connected to the motor 100.

In use, the fan 89 receives air through the air inlet 86 and circumferentially forces the air outwardly from the fan 89 and thereabout the heater element 94. Thus, it can be seen that heat evolving from the heater element 94 is in close proximity to the outer periphery 92 of the fan 89 for discharge therefrom. The fan 89 further forces the heated air to move outwardly toward the first and second sides 82 and 83 of the plenum 81. The heated air is allowed to exit the plenum 81 through the air outlet 87.

The disposition of the heater element 94 in proximity to the outer periphery 92 of the fan 89 is an advantage of the present invention in that the fan 89 and the motor 100 can be dimensioned smaller and yet evenly distribute the heated air. This results in a more efficient power usage and even circulation of heated air throughout the heating chamber 23.

The heated air is forced back into the heating chamber 23 via the air outlet 87. The air outlet 87 can be positioned near the first and second sides 82 and 83 of the convection heater assembly 80, and extend along the respective first and second sides 82 and 83 in a generally vertical direction, as shown in FIG. 3. This placement of the air outlet 87 produces an even distribution of heated air throughout the heating chamber 23. Moreover, the continuous flow of evenly distributed heated air quickly and evenly surrounds and heats the prepared food 11 which is disposed within the food warmer cabinet 10.

A control system 104 is adapted to and capable of selectively regulating the convection heater assembly 80 so as to maintain the desired temperature within the heating chamber 23. The control system 104 can be a commercially available unit which may include a digital read-out computer controller, an on/off switch with a red indicator light, a solid state relay, and a replaceable fuse disposed between the solid state relay and the computer controller.

A plurality of air inlets 106 (see FIG. 3) are formed in the bottom 18 of the inner shell 13 below the drawer 52*b* and are in communication with a plurality of air outlets 107 (see FIG. 4) provided on the cover plate 97. The plurality of air inlets 106 provide for air to be drawn therethrough the cavity 98 between the back 17 of the inner shell 13 and the back cover 28 of the housing assembly 12 and coolingly pass the motor 100 of the convection heater assembly 80. Thus, motor 100 is cooled by the passing air and is allowed to exit the cavity 98 through the plurality of air outlets 107 on the cover plate 97.

The disposition of the convection heater assembly 80 adjacent the back 17 of the inner shell 13 eliminates the need for under- drawer radiant heating elements, previously mentioned above. Thus, implementing the convection heater assembly 80 provides for the interior cavity 70 of the drawer 52*b* to retain considerably greater volume of prepared food 11 because the top drawer 52*a* and the bottom drawer 52*b*.

Further, referring to FIGS. 1 and 2, elimination of the under-drawer heating element, previously mentioned, provides for the opening 73 in the bottom 62 of the drawer 52*b*. The opening 73 allows heated air to more easily and efficiently circulate from the heating chamber 23 through the opening 73 and into the interior cavity 70 of the drawer 52*b*. This improved circulation of heated air promotes quick and even heating of the prepared food 11 in the food storage container 74 disposed in the drawer 52*b*.

Figure 5:
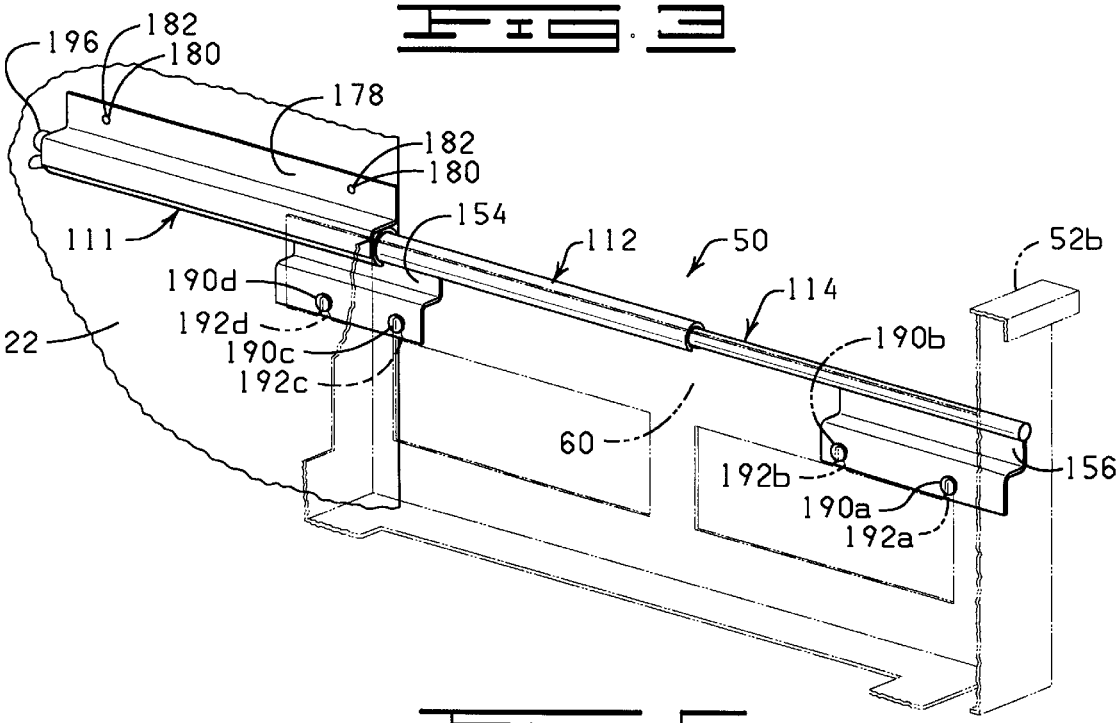
FIG. 5 is an exploded perspective representation of a slide assembly constructed in accordance with the present invention for supporting a drawer.

Referring now to FIG. 5, one of the slide assemblies 50 is shown in an exploded, perspective representation. Each of the slide assemblies 50 includes a support bracket 110, a tubular support member 11,a tubular transportal member 112, and a rod 114. The tubular transportal member 112 has a first end 116, a second end 118 and a side wall 120 defining a rod receiving passageway 122 therethrough. The tubular transportal member 112 has a first slot 124 and a second slot 126 with both of the first and second slots 124 and 126 openly communicating with the rod receiving passageway 122.

The first slot 124 extends from the first end 116 of the tubular transportal member 112 and terminates a distance 128 from the first end 116 of the tubular transportal member 112. The second slot 126 extends from the second end 118 of the tubular transportal member 112 and terminates a distance 130 from the second end 118 of the tubular transportal member 112. The first and second slots 124 and 126 are aligned and terminate a distance 132 apart such that a portion of the side wall 120 is disposed therebetween. Generally, the distance 128 is at least twice the distance 130.

The rod 114 has a first end 150, a second end 152, a first flange 154 and a second flange 156. The first flange 154 is connected to the rod 114 near the first end 150 of the rod 114. The second flange 156 is connected to the rod 114 near the second end 152 of the rod 114. The rod 114 is telescopingly disposed within the rod receiving passageway 122 of the tubular transportal member 112 for sliding movement therein. It will be understood that during construction only one of either the first or second flange 154 or 156 is initially connected to the rod 114. The rod 114 is then telescopingly disposed within the rod receiving passageway 122 of the tubular transportal member 112. Thereafter, the remaining first or second flange 154 or 156 is then connected to the rod 114 while the rod 114 is telescopingly disposed therein the tubular transportal member 112.

The tubular support member 111 of the slide assemblies 50 has a first end 170, a second end 172, and a side wall 174 defining a tubular receiving passageway 176 therethrough. The tubular receiving passageway 176 telescopingly receives the tubular transportal member 112 for sliding movement of the tubular transportal member 112 therein.

The tubular support member 111 is also provided with a slot 177 extending through the side wall 174 from the first end 170 of the tubular support member 111 to the second end 172 of the tubular support member 111. The slot 177, which is formed in the side wall 174 of the tubular support member 111, is aligned with the first and second slots 124 and 126, which are formed in the tubular transportal member 112. The slot 177, which is formed in the side wall 174 of the tubular support member 111 is sized to receive the first and second flanges 154 and 156 of the rod 114 for sliding movement therein.

The support bracket 110 is attached to the side wall 174 of the tubular support member 111. The support bracket 110 has a flange 178 which extends therefrom for connection of the tubular support member 111 to a stable object for supporting the slide assemblies 50. The stable object can be the housing assembly 12 or any other suitable cabinet, for example. Where it is desirous to install the slide assemblies 50 in an inverted fashion the flange 178 of the support bracket 110 can be modified to accomplish such inverted disposition of the slide assemblies 50.

Referring to FIGS. 3, 5, and 6, the flange 178 is provided with a plurality of apertures 180 for connecting the support bracket 110 to the first or second side walls 20 and 22 of the inner shell 13 of the housing assembly 12. The flange 178 can be attached with an attaching means 182, such as a standard nut and bolt assembly, rivet, weld, sheet metal screw or other suitable assembly for attaching the flange 178 to the first or second side walls 20 and 22 of the inner shell 13 of the housing assembly 12.

A plurality of brace members 184, shown in phantom, see FIG. 3, may be attached to the first and second side walls 20 and 22 of the inner shell 13 between the inner shell 13 and the outer shell 14 to support and reinforce the attachment of the slide assemblies 50. Such brace members 184 can be constructed of heavier gauge metal, such as 12 gauge, than that used in the construction of the inner and outer shells 13 and 14.

Referring to FIGS. 5 and 6, a plurality of button members 190, referred to herein via the same numeric prefix and a different alphabetic suffix, are attached to the first and second flanges 154 and 156 of the rod 114. The plurality of button members 190 extend outwardly from the first and second flanges 154 and 156. The drawer 52*b* is provided with a plurality of slots 192, referred to herein via the same numeric prefix and a different alphabetic suffix, formed in the first and second sides 58 and 60 thereof.

The slots 192 formed in the first and second sides 58 and 60 of the drawer 52*b* receive respective button members 190 of each of the slide assemblies 50 such that the drawer 52*b* may be attached to the slide assemblies 50 and thereafter detached and removed from the slide assemblies 50. The simplified attachment and detachment of the drawer 52*b* from the slide assemblies 50 is desirable for cleaning, repair, and replacement of the drawer 52*b*, and to provide access to the heating chamber 23 for cleaning and repair therein. However, it will be understood that other assemblies, other than the button members 190 and the slots 192, can be utilized to attach the drawer 52*b* to the slide assemblies 50.

Referring again to FIG. 5, the tubular transportal member 112 of each of the slide assemblies 50 is further provided with a retaining member 196 formed on the tubular transportal member 112, or connected to tubular transportal member 112. The retaining member 196 is positioned near the first end 116 of the tubular transportal member 112 for stopping the telescoping movement of the tubular transportal member 112 within the tubular support member 111 when the tubular transportal member 112 of each of the slide assemblies 50 is fully extended. That is, when the tubular transportal member 112 is fully extended from the tubular support member 111, the retaining member 196 is caused to contact the first end 170 of the tubular support member 111 to prevent the tubular transportal member 112 from being completely withdrawn from the tubular receiving passageway 176 of the tubular support member 111.

The tubular support member 111 and the tubular transportal member 112 can be coated with a substantially friction-free material 198, such as a nylon or other lubricating material. The friction-free material 198 has the effect of promoting the sliding engagement of the tubular transportal member 1 112 within the tubular receiving passageway 176 of the tubular support member 111, and the sliding engagement of the rod 114 within the rod receiving passageway 122 of the tubular transportal member 112.

In addition to providing smoother slidability, the friction-free material 198 reduces or prevents squeaking or other noises which may be generated by the movement of the tubular transportal member 112 within the tubular receiving passageway 176. Also, the addition of the friction-free material 198 assists the tubular transportal member 112 in being matingly disposed within the tubular receiving passageway to reduce the amount of play and/or undesirably movement therebetween.

In operation, the convection heater assembly 80 is actuated via the control system 104. The heating chamber 23 is heated, as described above, to the temperature selected is by the control system 104. One of the drawers 52*a* or 52*b* is withdrawn from a closed position within the heating chamber 23 to an extended position thereby causing the rod 114 to be telescopingly withdrawn from within the tubular transportal member 112. As the rod 114 is telescopingly withdrawn from the rod receiving passageway 122 of the tubular transportal member 112, the first flange 154 of the rod 114 slides within the first slot 124 of the tubular transportal member 112.

As the rod 114 is extended, an end 200 of the first flange 154 contacts a portion of the side wall 120 adjacent to the slot 124 to cause a force to be applied to the tubular transportal member 112. The force applied to the tubular transportal member 112 causes the tubular transportal member 112 to telescopingly slide within the tubular receiving passageway 176 of the tubular support member 111.

The tubular transportal member 112 is extended until the retaining member 196 of the tubular transportal member 112 abuts the first end 170 of the tubular support member 111 which causes the sliding movement of the tubular transportal member 112 to stop.

Once the drawer 52*b* is fully extended from the housing assembly 12, the drawer 52*b* can be loaded with the prepared food 11 and then inserted back into the heating chamber 23 by reversing the order of the steps discussed hereinbefore.

In one embodiment the tubular support member 111, the tubular transportal member 112, and the rod 114 can be constructed of a substantially rigid material such as polymeric material, wood, sheet metal, or steel. While the tubular support member 111, the tubular transportal member 112, and the rod 114 are shown to be generally circular or oval in shape, it will be understood that the tubular support member 111, the tubular transportal member 112 and the rod 114 can be generally square, triangular or other configurations and remain within the spirit and scope of the invention disclosed herein.

An advantage of the slide assemblies 50 of the present invention is that portions of the tubular support member 111, the tubular transportal member 112, and the rod 114 are overlapped and positioned in a mating, substantially concentric relationship so as to provide structural integrity and enhanced strength of the slide assemblies 50 at what may generally be considered to be its weakest location when the slide assemblies 50 are in the fully extended position and the drawer 52*b* is thereby removed from the heating chamber 23, as shown in FIG. 6.

A further advantage of the slide assemblies 50 of the present invention is that it remains operational even when the tubular support member 111, the tubular transportal member 112, and the rod 114 become bent, dirty or even clogged with food. Moreover, the slide assemblies 50 of the present invention are relatively simple and inexpensive to construct.

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. A slide assembly for supporting a drawer, comprising:

a tubular transportal member having a first end, a second end and a side wall defining a rod receiving passageway there through, the tubular transportal member having a first slot and a second slot openly communicating with the rod receiving passageway, the first slot extending from the first end of the tubular transportal member and terminating a distance from the first end, the second slot extending from the second end of the tubular transportal member and terminating a distance from the second end, the first and second slots being aligned and terminating a distance apart such that a portion of the side wall is disposed there between;

a rod having a first end, a second end, a first flange and a second flange, the first flange connected to the rod near the first end of the rod and the second flange connected to the rod near the second end of the rod, the rod telescopingly disposed within the rod receiving passageway of the tubular transportal member, the first flange and the second flange being connectable to the drawer;

a tubular support member having a first end, a second end, a side wall defining a tubular receiving passageway there through capable of telescopingly receiving the tubular transportal member, and a slot extending through the side wall from the first end of the tubular support member to the second end of the tubular support member with the slot formed in the side wall of the tubular support member being aligned with the first and second slots formed in the tubular transportal member and the slot formed in the side wall of the tubular support member being sized to receive the first and second flanges of the rod for sliding movement therein; and a support bracket attached to the side wall of the tubular support member, the support bracket having a flange extending therefrom for connection to a stable object.

2. The slide assembly of claim 1 wherein the distance the first slot terminates from the first end of the tubular transportal member is greater than the distance that the second slot terminates from the second end of the tubular transportal member.

3. The slide assembly of claim 1 wherein the distance the first slot terminates from the first end of the tubular transportal member is at least twice the distance that the second slot terminates from the second end of the tubular transportal member.

4. The slide assembly of claim 1 wherein the tubular transportal member and the tubular support member are coated with a substantially friction-free material.

5. The slide assembly of claim 1 wherein the rod is telescopingly disposed within the rod receiving passageway of the tubular transportal member such that the first flange of the rod is disposed through first slot of the tubular transportal member and the second flange of the rod is disposed through the second slot of the tubular transportal member.

6. The slide assembly of claim 5 wherein the rod is further defined as having a generally elongated rectangular configuration from the first end to the second end of the rod, and wherein the tubular transportal member is further defined as having a generally elongated rectangular configuration from the first end to the second end of the tubular transportal member, and wherein the tubular support member is further defined as having a generally elongated rectangular configuration from the first end to the second end of the tubular support member.

7. A food warmer cabinet, comprising:

a housing assembly defining a heating chamber, the housing assembly having at least one drawer-receiving opening in one side thereof openly communicating with the heating chamber;

a plurality of slide assemblies each supported within the heating chamber, each of the slide assemblies comprising:

a tubular transportal member having a first end, a second end and a side wall defining a rod receiving passageway there through, the tubular transportal member having a first slot and a second slot openly communicating with the rod receiving passageway, the first slot extending from the first end of the tubular transportal member and terminating a distance from the first end, the second slot extending from the second end of the tubular transportal member and terminating a distance from the second end, the first and second slots being aligned and terminating a distance apart such that a portion of the side wall is disposed there between, a rod having a first end, a second end, a first flange and a second flange, the first flange connected to the rod near the first end of the rod and the second flange connected to the rod near the second end of the rod, the rod telescopingly disposed within the rod receiving passageway of the tubular transportal member, the first and second flanges being connectable to a drawer, a tubular support member having a first end, a second end and a side wall defining a tubular receiving passageway there through capable of telescopingly receiving the tubular transportal member, and a slot extending through the side wall from the first end of the tubular support member to the second end of the tubular support member with the slot formed in the side wall of the tubular support member being aligned with the first and second slots formed in the tubular transportal member and the slot formed in the side wall of the tubular support member being sized to receive the first and second flanges of the rod for sliding movement therein, and a support bracket attached to the side wall of the tubular support member, the support bracket having a flange extending therefrom for connection to a stable object;

at least one drawer slidably supported by the slide assemblies such that the drawer can be slidably positioned within the heating chamber and slidably removed from the heating chamber, the drawer having an interior cavity for receiving and supporting a food storage container; and a convection heater supported by the housing assembly and positioned to inject heated air into the heating chamber without substantially interfering with the drawer being slidably positioned within the heating chamber and slidably removed from the heating chamber.

8. The food warmer cabinet of claim 7 wherein the distance the first slot terminates from the first end thereof is greater than the distance that the second slot terminates from the second end thereof.

9. The food warmer cabinet of claim 7 wherein the distance the first slot terminates from the first end thereof is at least twice the distance that the second slot terminates from the second end thereof.

10. The food warmer cabinet of claim 7 wherein the tubular transportal member and the tubular support member are coated with a substantially friction-free material.

11. The food warmer cabinet of claim 7 wherein the drawer is provided with a bottom and wherein a ledge is disposed about the bottom for supporting a food storage container.

12. A food warmer cabinet, comprising:

a housing assembly having an inner shell, an outer shell, a back, and a base, the inner shell having a top, a bottom, a first side wall, a second side wall, and a back defining a heating chamber, the inner shell having at least one drawer-receiving opening therein openly communicating with the heating chamber;

a convection heater supported within the heating chamber substantially adjacent at least a portion of the back of the housing assembly;

a plurality of slide assemblies spatially disposed within the heating chamber such that at least a first slide assembly is supported on the first side wall and at least a second slide assembly is supported on the second side wall such that the first and second slide assemblies are oppositely disposed in a parallel relationship, the plurality of slide assemblies each comprising:

a tubular transportal member having a first end, a second end and a side wall defining a rod receiving passageway there through, the tubular transportal member having a first slot and a second slot openly communicating with the rod receiving passageway, the first slot extending from the first end of the tubular transportal member and terminating a distance from the first end, the second slot extending from the second end of the tubular transportal member and terminating a distance from the second end, the first and second slots being aligned and terminating a distance apart such that a portion of the side wall is disposed there between, a rod having a first end, a second end, a first flange and a second flange, the first flange connected to the rod near the first end of the rod and the second flange connected to the rod near the second end of the rod, the rod telescopingly disposed within the rod receiving passageway of the tubular transportal member, the first and second flanges being connectable to a drawer, a tubular support member having a first end, a second end and a side wall defining a tubular receiving passageway there through capable of telescopingly receiving the tubular transportal member, and a slot extending through the side wall from the first end of the tubular support member to the second end of the tubular support member with the slot formed in the side wall of the tubular support member being aligned with the first and second slots formed in the tubular transportal member and the slot formed in the side wall of the tubular support member being sized to receive the first and second flanges of the rod for sliding movement therein, and a support bracket attached to the side wall of the tubular support member, the support bracket having a flange extending therefrom for connection to a stable object; and at least one drawer connected to and supported by at least two of the plurality of slide assemblies for sliding engagement therewith for permitting the drawer to be inserted within the heating chamber and to be withdrawn from the heating chamber, the drawer provided with an interior cavity for receiving a food storage container.

13. The food warmer cabinet of claim 12 wherein the distance the first slot terminates from the first end thereof is greater than the distance that the second slot terminates from the second end thereof.

14. The food warmer cabinet of claim 12 wherein the distance the first slot terminates from the first end thereof is at least twice the distance that the second slot terminates from the second end thereof.

15. The food warmer cabinet of claim 12 wherein the tubular transportal member and the tubular support member are coated with a substantially friction-free material.

16. A method for efficiently heating food, comprising the steps of:

providing a food warmer cabinet, comprising:

a housing assembly having a top, a bottom, a first side wall, a second side wall, a front, and a back all cooperating to define a heating chamber, the front having at least one drawer-receiving opening therein openly communicating with the heating chamber, a convection heater supported within the heating chamber substantially adjacent at least a portion of the back of the housing assembly, a plurality of slide assemblies spatially disposed within the heating chamber such that at least a first slide assembly is supported on the first side wall and at least a second slide assembly is supported on the second side wall such that the first and second slide assemblies are oppositely disposed in a parallel relationship, the plurality of slide assemblies each comprising:

a tubular transportal member having a first end, a second end and a side wall defining a rod receiving passageway there through, the tubular transportal member having a first slot and a second slot openly communicating with the rod receiving passageway, the first slot extending from the first end of the tubular transportal member and terminating a distance from the first end, the second slot extending from the second end of the tubular transportal member and terminating a distance from the second end, the first and second slots being aligned and terminating a distance apart such that a portion of the side wall is disposed there between, a rod having a first end, a second end, a first flange and a second flange, the first flange connected to the rod near the first end of the rod and the second flange connected to the rod near the second end of the rod, the rod telescopingly disposed within the rod receiving passageway of the tubular transportal member, a tubular support member having a first end, a second end and a side wall defining a tubular receiving passageway there through capable of telescopingly receiving the tubular transportal member, and a slot extending through the side wall from the first end of the tubular support member to the second end of the tubular support member with the slot formed in the side wall of the tubular support member being aligned with the first and second slots formed in the tubular transportal member and the slot formed in the side wall of the tubular support member being sized to receive the first and second flanges of the rod for sliding movement therein, a support bracket attached to the side wall of the tubular support member, the support bracket having a flange extending therefrom for connection to a stable object, at least one drawer connected to the first and second flanges of the slide assemblies and supported by the plurality of slide assemblies for sliding engagement therewith for permitting the drawer to be inserted within the heating chamber and to be withdrawn from the heating chamber, the drawer provided with an interior cavity for receiving a food storage container;

withdrawing, by an individual, the drawer of the food warmer cabinet such that the drawer is slidably drawn from the heating chamber supported by the slide assemblies connected thereto;

placing, by an individual, a food storage container containing food to be warmed into the drawer of the food warmer cabinet such that the food storage container is engagingly disposed within the drawer;

closing, by an individual, the extended drawer such that the drawer is inserted into the heating chamber; and heating, by the convection heater of the food warmer cabinet, the food placed in the food storage container disposed within the drawer.

17. A food warmer cabinet, comprising:

a housing assembly defining a heating chamber, the housing assembly having at least one drawer-receiving opening in one side thereof openly communicating with the heating chamber;

a plurality of slide assemblies supported within the heating chamber;

at least one drawer slidably supported by the slide assemblies such that the drawer can be slidably positioned within the heating chamber and slidably removed from the heating chamber, the drawer having an interior cavity for receiving and supporting a food storage container, the drawer provided with a bottom having a ledge disposed about the bottom, the ledge defining an opening wherein the opening is in open communication with the heating chamber; and a convection heater supported by the housing assembly and positioned to inject heated air into the heating chamber without substantially interfering with the drawer being slidably positioned within the heating chamber and slidably removed from the heating chamber.

18. A food warmer cabinet, comprising:

a housing assembly having an inner shell, an outer shell, a back, and a base, the inner shell having a top, a bottom, a first side wall, a second side wall, and a back defining a heating chamber, the inner shell having at least one drawer-receiving opening therein openly communicating with the heating chamber;

a convection heater supported within the heating chamber substantially adjacent at least a portion of the back of the housing assembly;

a plurality of slide assemblies spatially disposed within the heating chamber such that at least a first slide assembly is supported on the first side wall and at least a second slide assembly is supported on the second side wall such that the first and second slide assemblies are oppositely disposed in a parallel relationship; and at least one drawer connected to and supported by at least two of the plurality of slide assemblies for sliding engagement therewith for permitting the drawer to be inserted within the heating chamber and to be withdrawn from the heating chamber, the drawer provided with an interior cavity for receiving a food storage container, the drawer provided with a bottom having a ledge disposed about the bottom, the ledge defining an opening wherein the opening is in open communication with the heating chamber.

19. A food warmer cabinet, comprising:

a housing assembly having an inner shell, an outer shell, a back, and a base, the inner shell having a top, a bottom, a first side wall, a second side wall, and a back defining a heating chamber, the inner shell having at least one drawer-receiving opening therein openly communicating with the heating chamber;

a convection heater supported within the heating chamber substantially adjacent at least a portion of the back of the housing assembly;

a plurality of slide assemblies spatially disposed within the heating chamber such that at least a first slide assembly is supported on the first side wall and at least a second slide assembly is supported on the second side wall such that the first and second slide assemblies are oppositely disposed in a parallel relationship;

at least one drawer connected to and supported by at least two of the plurality of slide assemblies for sliding engagement therewith for permitting the drawer to be inserted within the heating chamber and to be withdrawn from the heating chamber, the drawer provided with an interior cavity for receiving a food storage container; and a plurality of air inlets formed in the a portion of the bottom of the inner shell and wherein the food warmer cabinet is provided with a plurality of air outlets centrally disposed in the back of the housing assembly, the plurality of air inlets formed in the portion of the front in circulating communication with the plurality of air outlets centrally disposed in the back.

* * * * *